United States Patent [19]

Bean

[11] 3,973,958

[45]*Aug. 10, 1976

[54] METHOD INCLUDING EXPOSURE OF DEFORMATION IMAGING MEMBER THROUGH LENTICULAR LENS ELEMENT

[75] Inventor: Lloyd F. Bean, Rochester, N.Y.

[73] Assignee: Xerox Corporation, Stamford, Conn.

[ * ] Notice: The portion of the term of this patent subsequent to Oct. 9, 1990, has been disclaimed.

[22] Filed: Dec. 28, 1973

[21] Appl. No.: 429,446

[52] U.S. Cl. ..... 96/1.1; 96/45; 96/81

[51] Int. Cl.[2] ..... G03G 16/00

[58] Field of Search ..... 96/1.1, 45, 81

[56] References Cited

UNITED STATES PATENTS

| | | | |
|---|---|---|---|
| 1,838,173 | 12/1931 | Chretien | 96/45 |
| 3,214,272 | 10/1965 | Ploke | 96/1.1 |
| 3,322,034 | 5/1967 | Cary | 96/1.1 |
| 3,458,309 | 7/1969 | Gaynor | 96/81 |
| 3,542,556 | 11/1970 | Jones | 96/26 |
| 3,716,359 | 2/1973 | Sheridon | 96/1.5 |
| 3,764,311 | 10/1973 | Bean | 96/45 |

*Primary Examiner*—David Klein
*Assistant Examiner*—Judson R. Hightower
*Attorney, Agent, or Firm*—James J. Ralabate; Michael H. Shanahan; George J. Cannon

[57] ABSTRACT

A method is set forth for increasing the sensitivity and speed of a deformation imaging system. A lenticular lens array is interpositioned between the deformation imaging member and the imaging lens to thereby focus the radiation into a sharp relatively high intensity dot or line pattern.

10 Claims, 6 Drawing Figures

METHOD INCLUDING EXPOSURE OF DEFORMATION IMAGING MEMBER THROUGH LENTICULAR LENS ELEMENT

BACKGROUND OF THE INVENTION

This invention relates generally to deformation imaging.

Deformation imaging may be generally described as a technique for recording images on a deformable layer by the combined application of an electrostatic field and a softening influence on the deformable layer. For example, two such techniques are known as "relief" imaging and "frost" imaging. These techniques basically involve applying a latent electrostatic image or a charge pattern to an insulating deformable layer which is softened by the application of heat or solvent vapor, softening the deformable layer until the electric field force of the charge pattern deforms the layer and then rigidifying the layer in its deformed state.

In frost imaging, the deformation comprises a series of very small surface folds or wrinkles with the depth of the folds in any particular surface location dependent upon the amount of charge in that area. The image produced has a frosted appearance, has good continuous tone response and solid area coverage. Relief imaging, on the other hand, produces ridge-like deformations in the deformable layer at the situs of potential gradients in the applied charge pattern, exhibiting an edge effect. Thus, relief imaging is most suitable for the reproduction of high contrast subjects such as line copy or the like. Other deformation imaging techniques, such as that described in U.S. Pat. No. 2,896,507 have been devised and are suitable for use with the instant invention.

Once a deformation image is formed, it may be fixed by allowing or causing the film to reharden by removal of heat or solvent vapors, or by cooling if necessary. It is also possible to erase such images after they have been viewed by simply resoftening the film and maintaining a low viscosity for a sufficient period of time. Discharge is believed to occur by fluid migration of the ions making up the charge pattern from the top surface of the deformed film while it is still soft during initial deformation. Surface tension forces restore a smooth surface to the film on resoftening, so that it is ready for reuse in the system.

The ability to see images of this type is based on the deformed surfaces serving as light scattering centers changing the angles of reflection or transmission of incident light. Of course, the characteristics of the deformation images are dependent upon the optical system employed in projecting the image to be reproduced by deformation onto the surface of the deformable layer. Some such systems utilize optical screens and filters to extend dynamic range, such as U.S. Pat. No. 3,698,,892, filed Apr. 10, 1970. However, these systems do involve the loss of some radiation by reflection or absorption by the screen or filter.

One additional type of deformation imaging member to which the instant invention applies is called a Ruticon. Such a device is disclosed in U.S. Pat. No. 3,716,359 which is hereby expressly incorporated herein by reference. Ruticons are solid-state cyclic image recording devices. They have a layered structure comprised of a conductive transparent substrate, a thin photo-conductive layer, a thin deformable elastomer layer, and a deformable electrode such as a conductive liquid, a conductive gas, or a thin flexible metal layer. When an electric field is placed between the conductive substrate and the deformable electrode the elastomer will deform into a surface relief pattern corresponding to the light intensity distribution of an image focused on the photoconductor. Light modulated by the deformation of the elastomer surface can, in turn, be converted to an intensity distribution similar to the original image by means of simple optics. Ruticons have numerous useful applications such as image intensification, holographic recording and optical buffer storage systems.

The general basis of the instant invention lies in the use of lenses to redirect radiation into a predetermined configuration. Theoretically, a perfect lens is one which shows an image of a point as a point, and a straight line as a straight line. But in practice, the lenses are never perfect; they reproduce a point as a patch, and a straight line as a more less curved band. The problems associated with lenses are inherent in the construction, and an optical system designer controls most of the aberrations by combining a number of single lenses such that the aberrations of one lens tend to cancel out the aberrations of another lens.

Axial aberrations are aberrations which affect an image point on the axis of the lens. The two principal axial aberrations are chromatic aberrations and spherical aberrations. Chromatic aberrations merely reflect the fact that a single lens made from a single type of optical glass will refract blue rays more strongly than green rays, which in turn are refracted more strongly than red rays. Thus, a three dimensional spacial positioning of the colored rays results from and is referred to as, chromatic aberration. Spherical aberration involves the phenomenon that rays coming from an object on the axis of a lens and going through the center of the lens come to a focus at a certain point on the axis of the lens. Rays from an axial object going through the lens near the edges should come to a focus at the same point, but in practice, because of spherical aberration, they tend to come toward a different point of focus. The difference between these focal points is the spherical aberration of the lens. Spherical aberration increases with the lens aperture. In a simple converging lens, spherical aberration causes the rays farthest from the lens axis to converge more strongly, and come to a focus nearer the lens than the central rays close to the lens axis. The image is never fully sharp. Spherical aberration does not vary with image size, but rather varies to the square of the aperture.

More specifically, the instant invention is concerned with the use of lenticular lens systems as a means of redirecting imaged light rays. A lenticular system is one which employs a lenticular screen to break up an image into linear and area components which are subsequently combined. The purpose of splitting is usually to accommodate two or more images interspersed in each other on the same area. Uses of a lenticular screen or lenticular system are usually for lenticular color photography, stereo photography, image disection, and multiple image storage.

The main component of a lenticular system is the lenticular element itself, consisting of a transparent support embossed with a regular screen of lens surfaces. Usually these are cylindrical running across the screen in one direction of strips. By embossing a second set of linear elements that run angularly to the first, another type of lenticular lens, consisting of individual lens elements, is obtained. If the relative angle between the lens arrays is 90°, a spherical lenticular lens is created.

When the lenticular element is placed in front of the surface on which the camera lens projects an image, the individual lenticular elements break up the image into lines or points. They concentrate the elements into a smaller area, leaving spaces between them. Additionally, images can be recorded in the spaces by slightly displacing the lens laterally or by moving the object in front of the lens. The record or recorded image then contains a series of interlaced images which can be reconstituted by observation through a similar lenticular screen. The lenticular screen breaks up the image into line elements with spaces between them. If the screen is moved, a new set of line elements is formed in the spaces between the first set.

Lenticular lenses per se are not new in the imaging arts, and have been used for a good number of years to concentrate and intensify light. For example, U.S. Pat. No. 1,824,353, discloses the use of various shaped lenses to accomplish this exact end result. It is to be noted, however, that this patent is limited to the exposure of photographic plates and permits direct viewing of the formed image only through the image forming optical system.

Another patent which broadly teaches the use of lenticular lenses as a means of intensifying light is U.S. Pat. No. 1,849,036. Here again, it should be noted that the disclosure is limited to the exposure of photographic plates and permits direct viewing of the formed image only through the image forming optical system.

Both of the patents discussed immediately above are, like all photographic systems, dependent upon the light absorption characteristics of the film used. This is to be contrasted with the light reflective or scattering characteristics of the deformation imaging films of the instant invention. U.S. Pat. No. 3,413,117 discloses, in FIG. 7, a deformation imaging system employing an integrated lenticular element and single recording layer. The primary concern of this patent is the creation of color images through the use of filters and lenticular screens. It should be noted that read-out is accomplished by illumination through the entire recording number and lenticular element.

BRIEF DESCRIPTION OF THE DRAWINGS

The nature of the invention will be more easily understood when it is considered in conjunction with the accompanying drawings of an exemplary preferred embodiment of the invention wherein.

BRIEF SUMMARY OF THE INVENTION

It is an object of this invention to increase the photographic sensitivity of deformation imaging systems.

It is a further object of this invention to increase the photographic speed of deformation imaging systems.

Another object of this invention is to increase photographic sensitivity and speed of deformation imaging systems by simply using a lenticular element having good optical qualities and focusing same in such manner as to produce a substantially perfect image.

These and other objects are accomplished by providing a method for increasing the sensitivity and speed of a deformation imaging system. A lenticular lens array is interpositioned between the deformation imaging member and the imaging lens to thereby focus the radiation into a sharp relatively high intensity dot or line pattern.

DESCRIPTION OF THE PREFERRED EMBODIMENT

Figure 1:
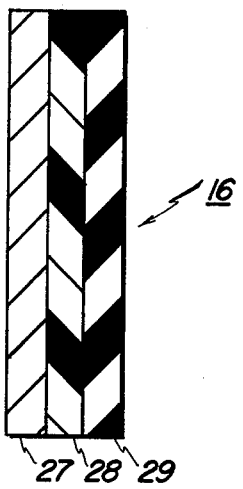
FIG. 1 is a partially schematic cross-sectional view of one embodiment of a thermoplastic recording medium according to the invention.

Referring now to FIG. 1, there is shown the cross-section of one exemplary embodiment of a suitable recording member for use in the invention. This recording member generally designated 16 may be in the form of a web, a rigid plate, a flexible endless belt or any other suitable mechanical configuration. Although not entirely necessary, the recording member generally designated 16 includes an electrically conductive substrate so as to facilitate charging prior to an imagewise discharge of the recording member upon exposure. Suitable substrates include flexible metal foil or plates made of materials such as aluminum, brass, copper, etc., as well as fairly heat resistant polymers such as polyethelene terephthalate, polycarbonates, polyurethanes, and the like coated with thin transparent conductive layers of tin oxide, copper iodide, or the like. With certain charging techniques such as two-sided corona discharge where corona discharge of positive polarity is applied to one side of the recording member while negative corona discharge is applied to the other, the conductive substrate may be eliminated from the system; however, it is generally desirable to incorporate such a substrate to provide mechanical strength in the overall recording member. Over the substrate is a photoconductive insulating layer 28 and a deformable insulating thermoplastic layer 29. The photoconductive layer 28 may consist of any suitable conductive insulating material such as amorphous selenium or photoconductive pigments such as cadmium sulfide, cadmium selenide, zinc sulfide, zinc oxide, lead oxide, lead sulfide, mercuric sulfide, antimony sulfide, mercuric oxide, indium trisulfide, titanium dioxide, arsenic sulfide, gallium triselenide lead iodide, lead selenide, lead telluride, gallium telluride, mercuric selluride, and the iodide sulfide selenide and tellurides of bismuth, aluminum, and molybdemum dispersed in an insulating film-forming binder such as a silicone resin, a styrene butadiene resin or the like. Other typical photoconductors include the organics, especially when these are complexed with small amounts of Lewis acids. Typical of these organic photoconductors are 1,4-dicyano-napthalene; anthracene 3-benzylidene amino carbazole, 2,5-bis-(p-aminophenylol)-1,3,4-oxidiazole; viyl carbazole; 2,4-diphenyl-quinazolin; 1-methyl-2-(3′, 4′-dihydroxy-methylene-phenol)-benzimidazole and substituted and unsubstituted phthalocyanines and quinacridones in solutions or dispersed in insulating film forming binders of the type described above. Any suitable deformable insulating thermoplastic layer may be used as layer 29. Typical insulating thermoplastics include the glycerol and pentarythritol esters of partially hydrogenated rosins; polyalphamethyl styrene, terpolymers of styrene, indene and isoprene; Piccolyte, S-70 and S-100 (polyterpene resins made from beta-pinene available from Pennsylvania Industrial Chemical Co. and having ring and ball melting points of 70° and 100°C, respectively); Piccopale 70SF and Piccopale 85 (nonreactive olefindiene resins available from Pennsylvania Industrial Chemical Co., having melting points of 70° and 85°C and molecular weights of 800 and 1,000 respectively); Piccodiene 2212 (a styrene butadiene resin available from the same company; Piccolastic A-75, D-100 and E-100, polystyrene resins with melting points of 75°, 100° and 100°C respectively, available from the same company); Coumarone Indene Resins available under the trade names Neville R-21 and Nevillac Hard; Amberol St-137X (an unreactive, unmodified phenol formaldehyde resin available from the Rohm and Hass Chemical Company of Philadelphia, Pa.; Aroclor 1242, a chlorinated polyphenyl resin); Piolite AC (a styrene acrylate copolymer); Piolite VTAC (a vinyl tolueneacrylate copolymer); Neolyn 23 (an alkyd resin available from Hercules Powder Company) and mixtures of silicone and styrene resins. In addition, the thermoplastic insulating layer itself may be photoconductive as shown by layer 30 in FIG. 2 and this may be accomplished by taking any suitable photoconductive material and dispersing it, mixing it in solid solution, or copolymerizing it with the resin material to form a single layer upon which the recording is to take place. In another approach, the thermoplastic insulating polymer of this type may be blended with a complexing agent to make it photoconductive by forming a photoconductive charge transfer complex. Thus, for example, phenol formaldehyde polymer may be made photoconductive by complexing it with 2,4,7-trinitrofluoroeone or any other suitable Lewis acid. In still a third embodiment of the recording member not shown, electrodes may be provided on both sides of the sandwich made up of a photoconductive insulating layer and a deformable insulating thermoplastic so that the required charge may be applied through the electrodes rather than by corona discharge or some other form of ionizing discharge as the type used with recording webs of FIGS. 1 and 2.

Figure 2:
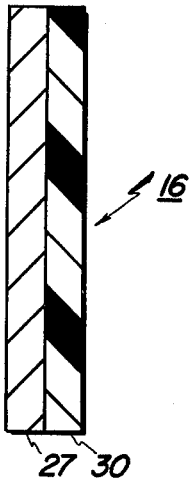
FIG. 2 is a partially schematic cross-sectional view of a second embodiment of a thermoplastic recording medium for use in the invention.

In imaging the recording web of FIG. 1, the thermoplastic insulating surface 29 of the web is first charged by grounding the conductive backing 27 and passing it under a corona generating electrode connected to a source of high potential adapted to uniformly charge the web. This type of corona charging technique is more fully described in U.S. Pat. No. 2,588,699 to Carlson and U.S. Pat. No. 2,836,725 to Vyverberg. However, it is to be understood that any other suitable charging method may be used. Once the recording member 16 has been uniformly charged, it is exposed in the absence of ambient light. If the recording member of FIG. 1 is then recharged in the dark to uniform potential, a higher level of charge is built up on exposed areas of the recording web, owing to the movement of charge through the photoconductive layer 28 during exposure. This charge is then trapped on opposite sides of the thermoplastic layer 29 so that the recording web may even be handled in the light after the recharging step has been carried out. Formation of the image may be accomplished by heating the thermoplastic surface which then carries a charge conforming to the image pattern with hot air or radient heat or any other suitable heat source or by subjecting it to a solvent vapor or some other suitable softening influence. Ripples then appear in the surface of the thermoplastic owing to the effect of the charge pattern on the softened material. This deformation technique is more fully described in the recent literature. See, for example, an article entitled, "A Cyclic Xerographic Method Based on Frost Deformation", by R. W. Gundlach and C. J. Claus, appearing in the January-February 1963 issue of the Journal of Photographics Science and Engineering, and U.S. Pat. Nos. 3,113,179; 3,196,011 and 3,196,008 all of which are hereby expressly incorporated herein by reference. When a recording member of the type shown in FIG. 2 is employed, softening of the photoconductive thermoplastic receiving layer 30 is carried out in the dark so that the imagewise charge pattern is not dissipated.

Figure 3:
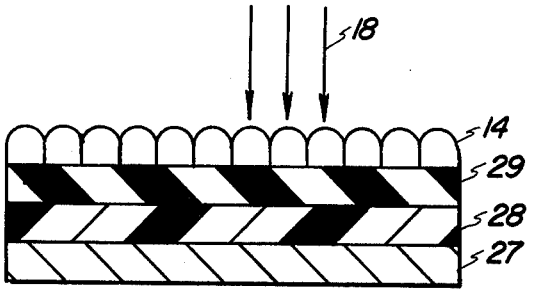
FIG. 3 is a partially schematic cross-sectional view of the recording medium of FIG. 1 and the lenticular elements of the instant invention.

Referring now to FIG. 3, lenticular element 14 is placed on top of, and in contact with, thermoplastic layer 29. As the light pattern 18 impinges upon element 14, it is concentrated into dots, or lines, as explained below in the discussion of FIG. 4.

Figure 4:
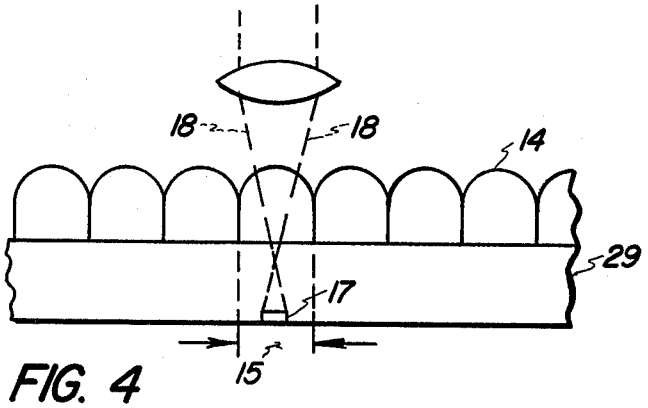
FIG. 4 is a partially schematic cross-sectional view of the exposure through the lenticular element illustrating the light intensity distribution of the invention.
Figure 6:
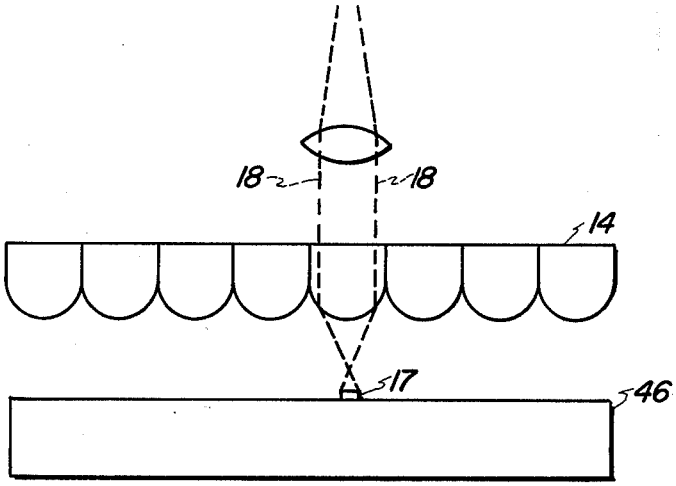
FIG. 6 is a partially schematic cross-sectional view of another embodiment of the instant invention showing a lenticular element in a reverse position to those shown in FIGS. 3 and 4.

Lenticular element 14 is illustrated in FIGS. 3 and 4 in contact with the surface of layer 29; however, this is not necessarily true of every embodiment. It is possible, as shown in FIG. 6, to space the element from the surface by varying the optical parameters of the element. In fact for obvious reasons, it is preferred in many instances that there be no physical contact between the element and the imaging member. Zero clearance is undesirable for a number of reasons, e.g., the interference with the charge and development steps.

When the lenticular element 14 is used in actual contact with the imaging member during exposure, it is obvious that the development step may present difficulties. In some situations it is necessary to remove, or displace, the element to a location sufficiently remote to allow heating or softening of the member. On the other hand, it is not necessary to remove the lens if it is made of a material which is not affected by the heat or solvent used to develop the member — in such a structure it is feasible that the lenticular element be an integral part of the imaging member. The application of a solvent, or solvent vapors, in such a situation would then depend upon the porosity of the layered portions of the imaging member.

The instant invention has a number of distinct advantages over the prior art systems. For example, it is not necessary for the inventive lenticular screen to be in contact, or integral with, the imaging member during viewing, thereby providing reusability and decreased manufacturing costs. Furthermore, the reusable feature of the screen allows imaging from either side, more flexibility in the selection of imaging member materials, and increased simplicity in the application of developing solvents, heat etc.

FIG. 4 is an enlarged partially schematic, partially cross-sectional view of the imaging member while undergoing imagewise exposure through the lenticular element. Without the lenticular element 14 present, the illuminating light would, per unit area, completely and with relative unifomr uniform cover area 15. The lenticular element 14 causes the light rays 18 to converge and concentrate at point 17 which is then at a very high intensity compared to the remainder of the unit area. Choosing a lenticular element exhibiting high optical qualities provides a highly efficient light intensification system, since light is not lost, but merely redirected to a smaller area. The terminology "high optical qualities" refers to the lens system as a whole, and not just the lens itself. In other words, the lens is optically good and it is focused on the imaging member to produce a substantially perfect image. In other words, the resolution of the lens must be great enough to resolve the area which it is desired to illuminate or make bright.

The intensification referred to in the above paragraph is what provides the increase in sensitivity. Or, in other words, the increase in sensitivity equals the area of the lens 15, divided by the area of the image 17.

Figure 5:
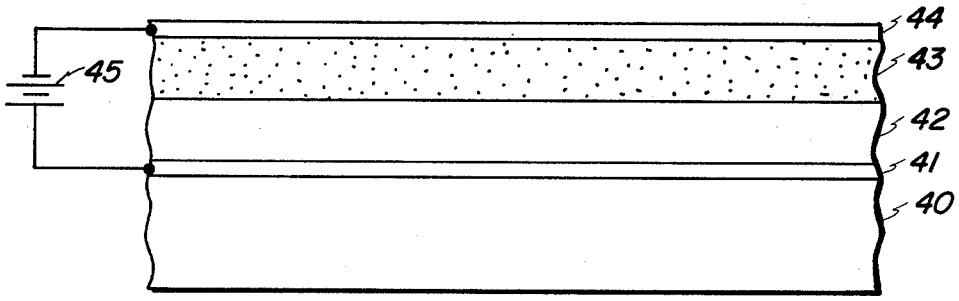
FIG. 5 is a partially schematic cross-sectional view of a Ruticon imaging member which would benefit from the use of a lenticular element positioned according to the teachings of the instant invention.

Referring now to FIG. 5, there is shown an exemplary embodiment of a Ruticon imaging device. The device comprises a transparent substrate 40 having a conductive surface 41 thereon. Elements 40 and 41 can be separate or combined such as commonly available NESA glass. Photoconductive layer 42 is a material which will allow the passage of more electric charge in those regions which are exposed to light. The elastomer layer 43 may be of a class of elastomeric soft solid materials for use in this application including both natural, such as natural rubbers and synthetic polymers which have rubber like characteristics, i.e., are elastic. Finally, on the surface of the elastomer is positioned a thin continuous conductive layer 44 which is flexible enough to follow the deformations of the elastomer.

As explained in the BACKGROUND OF THE INVENTION, a d.c. voltage is used to retain an image on a Ruticon member. Element 45 of FIG. 5 is a d.c. voltage source and is applied between the conductive layer 41 and the surface layer 44.

Image input and readout both may occur on surface 44, however, some embodiments have input and readout on opposite faces.

FIG. 6 shows another embodiment of the inventive system wherein the element 14 is out of contact with deformation imaging member 46. Illumination of a lenticular element in such a fashion causes the focal point 17 to extend beyond the surface of the element. Therefore, it is possible to locate the element away from the imaging member.

The number of lenticules per milimeter, or lenticular frequency, is of some importance when designing a system according to the instant invention for a particular imaging member. Preferably, the lenticular frequency should be approximately 1/4 to two times the resonant frequency of the film used. It is not always necessary that the above range be satisfied, so long as the area on the film between lenticules is also light scattering or refracting. A lenticular element which produces perfect images provides a system with high sensitivity (see copending U.S. Pat. application Ser. No. 429,445, filed Dec. 28, 1973, while a lenticular element which produces imperfect images (see copending U.S. patent applications: Ser. Nos. 429,253 filed Dec. 28, 1973 and 429,423, filed Dec. 28, 1973 provides a system with greater acceptance, i.e., extended range.

It can be seen, then, that the concepts of the instant invention increase photographic speed, or sensitivity, at the expense of resolution.

Although specific components and proportions have been stated in the above description of preferred embodiments, other suitable materials, as listed herein, may be used with similar results. In addition, other materials may be added to the materials used herein and variations may be made in the imaging members and process steps hereof to synergize, enhance, or otherwise modify its properties.

It will be understood that various changes in the details, materials, steps and arrangements of parts, which have been herein described and illustrated in order to explain the nature of the invention, will occur to and may be made by those skilled in the art upon a reading of this disclosure, and such changes are intended to be included within the principle and scope of this invention.

What is claimed is:

1. A method of increasing the sensitivity and speed of a deformation imaging system comprising the steps of:

a. providing a deformation imaging member comprising a photoconductive layer in contact with a deformable layer of resonant frequency $f_R$, said deformable layer having a substantially uniform electric field thereacross; and b. imagewise exposing said imaging member to activating electromagnetic radiation through a lenticular lens array adjacent but out of contact with the surface of the imaging member and in optical focus with the surface of the photoconductive layer in contact with said deformable layer, the ratio of lenticule per millimeter in said lens array to said resonant frequency being from about 1:4 up to less than 1:1, said lenticular array comprising lenses having a resolution sufficient to maintain the optical focus during said imagewise exposure.

2. The method of claim 1 wherein said lenticular lens array comprises a spherical lens.

3. The method of claim 1 wherein said lenticular lens array comprises a cylindrical lens.

4. A method of increasing the sensitivity and speed of a deformation imaging system comprising the steps of:

a. providing an imaging member comprising a support layer, a photoconductive layer overlying said support layer and a charge retaining surface deformable layer overlying said photoconductive layer and having a resonant frequency $f_R$; and b. imagewise exposing said imaging member to activating electromagnetic radiation through a lenticular lens in contact with the surface of said imaging member and in optical focus with the surface of said photoconductive layer in contact with said deformable layer; the of lenticules per millimeter in said lens array to said resonant frequency being from about 1:4 up to about less than 1:1, said lenticular array comprising lenses having a resolution sufficient to maintain the optical focus during said imagewise exposure.

5. The method of claim 4 further including the step of developing said image.

6. The method of claim 4 wherein said lenticular lens array comprises a cylindrical lens.

7. The method of claim 4 wherein said lenticular lens array comprises a spherical lens.

8. A method of increasing the sensitivity and speed of a deformation imaging member comprising the steps of:

a. providing an imaging member comprising a layer of photoconductive material, an electric field deformable elastomer layer adjacent said photoconductive material layer and having a resonant frequency $f_R$, and a deformable conductive layer adjacent said elastomer layer;

b. subjecting said imaging member to an electric field; and c. imagewise exposing a photoconductive layer to activating electromagnetic radiation through a lenticular lens array in contact with said deformable layer and in optical focus with the surface of said photoconductive layer adjacent said elastomer layer; the ratio of lenticules per millimeter in said lens array to said resonant frequency being from about 1:4 up to less than 1:1 said lenticular array comprising lenses having a resolution sufficient to maintain the optical focus during said imagewise exposure.

9. The method of claim 8 wherein said lenticular lens array comprises a cylindrical lens.

10. The method of claim 8 wherein said lenticular lens array comprises a spherical lens.

* * * * *